US011821391B2

(12) United States Patent
Lee

(10) Patent No.: US 11,821,391 B2
(45) Date of Patent: Nov. 21, 2023

(54) NOISE REDUCTION TYPE PURGE CONTROL SOLENOID VALVE

(71) Applicant: HYUNDAI KEFICO CORPORATION, Gyeonggi-do (KR)

(72) Inventor: Ahn Hee Lee, Gyeonggi-do (KR)

(73) Assignee: Hyundai Kefico Corporation, Gyeonggi-do (KR)

( * ) Notice: Subject to any disclaimer, the term of this patent is extended or adjusted under 35 U.S.C. 154(b) by 162 days.

(21) Appl. No.: 15/621,287

(22) Filed: Jun. 13, 2017

(65) Prior Publication Data

US 2017/0356395 A1 Dec. 14, 2017

(30) Foreign Application Priority Data

Jun. 13, 2016 (KR) ..... 10-2016-0073177

(51) Int. Cl.
*F02M 25/08* (2006.01)

(52) U.S. Cl.
CPC . *F02M 25/0836* (2013.01); *F02M 2025/0845* (2013.01); *F02M 2200/09* (2013.01)

(58) Field of Classification Search
CPC ..... F02M 25/0836; F02M 2025/0845; F02M 2200/09; F02M 2200/30; F02M 2200/306; F02M 21/0257; H01F 7/088; H01F 7/1638; H01F 2007/1661; H01F 27/33; F16K 31/10; F16K 31/103; F16K 47/02; F16K 47/04
(Continued)

(56) References Cited

U.S. PATENT DOCUMENTS 2,735,047 A * 2/1956 Garner ..... H01F 7/12 335/262
3,850,040 A * 11/1974 Orr, Jr ..... G01N 15/0893 73/865.5
(Continued)

FOREIGN PATENT DOCUMENTS

JP 62195452 A * 8/1987
JP H 07 269736 A 10/1995
(Continued)

OTHER PUBLICATIONS

Chinese Office Action dated Sep. 28, 2018 in corresponding Chinese Patent Application No. 201710441691.2 (including English translation).

*Primary Examiner* — Logan M Kraft
*Assistant Examiner* — Joshua Campbell
(74) *Attorney, Agent, or Firm* — Fox Rothschild LLP

(57) ABSTRACT

A noise reduction type purge control solenoid valve includes a body including a connector that supplies electricity from the exterior; a cover coupled to the body having a fluid inlet and a fluid outlet, and formed with a fluid discharge passage connected to the fluid outlet therein; a solenoid component disposed in the body; and an armature disposed between the solenoid component and the fluid discharge passage and moving upward and downward by the solenoid component to open and close the fluid discharge passage. Further, a noise reduction member is mounted on the armature to reduce noise generated by contact between the fluid discharge passage and the armature. A noise reduction wall protrudes along a circumference of an upper surface of the noise reduction member.

5 Claims, 6 Drawing Sheets

(58) Field of Classification Search
USPC ..... 335/257; 251/340
See application file for complete search history.

(56) References Cited

U.S. PATENT DOCUMENTS

| | | | | | |
|---|---|---|---|---|---|
| 4,245,789 | A * | 1/1981 | Gray | F02M 51/0664 | 239/585.4 |
| 4,725,041 | A * | 2/1988 | Chauvin | F02M 51/0632 | 239/585.4 |
| 4,826,132 | A * | 5/1989 | Moldenhauer | F16K 31/0655 | 251/368 |
| 6,158,713 | A * | 12/2000 | Ohya | F16K 31/082 | 251/129.21 |
| 6,415,817 | B1 * | 7/2002 | Krimmer | F02M 25/0836 | 137/550 |
| 6,651,951 | B2 * | 11/2003 | Krimmer | F16K 31/0655 | 123/568.21 |
| 2010/0012091 | A1 * | 1/2010 | Kannan | F02M 69/465 | 123/456 |
| 2014/0076286 | A1 * | 3/2014 | Karim | F02M 25/0872 | 123/520 |
| 2014/0346382 | A1 * | 11/2014 | Scheffel | F16K 31/06 | 251/129.15 |
| 2015/0157503 | A1 * | 6/2015 | Chon | A61F 9/00763 | 606/169 |

FOREIGN PATENT DOCUMENTS

| | | | |
|---|---|---|---|
| JP | 2008 291916 | A | 12/2008 |
| KR | 10-0820708 | B1 | 4/2008 |
| KR | 101137529 | B1 * | 4/2012 |
| KR | 2013 0046909 | A | 5/2013 |
| KR | 10 1396739 | B1 | 5/2014 |

* cited by examiner

NOISE REDUCTION TYPE PURGE CONTROL SOLENOID VALVE

CROSS-REFERENCE TO RELATED APPLICATION

This application claims priority to Korean Patent Application No. 10-2016-0073177, filed on Jun. 13, 2016, the disclosure of which is incorporated herein by reference in its entirety.

BACKGROUND

Field of the Disclosure

The present disclosure relates to a solenoid valve, and more particularly, to a noise reduction type purge control solenoid valve (PCSV) for reducing noise generated from a PCSV of a vehicle.

Description of the Related Art

Generally, a purge control solenoid valve is a valve positioned between an intake manifold and a canister and controls fuel evaporation gas collected in the canister, and prevents the fuel evaporation gas from being leaked to the external environment generates significant operating noise during idling or low-speed driving of a vehicle. A fuel evaporation gas is generated as fuel evaporates in a fuel tank and an evaporator when an engine stops. The generated fuel evaporation gas is absorbed and stored in the canister thereby preventing the fuel evaporation gas from being released into the atmosphere. Further, the fuel evaporation gas absorbed in the canister is introduced into the intake manifold again according to a determination of an ECU collecting information of each sensor to thereby be burned.

However, significant noise is generated every time the purge control solenoid valve operates and the quite operation of the vehicle is disturbed. Accordingly, there is a high demand for an apparatus capable of reducing noise during the repetitive operation of the purge control solenoid valve.

The above information disclosed in this section is merely for enhancement of understanding of the background of the disclosure and therefore it may contain information that does not form the prior art that is already known in this country to a person of ordinary skill in the art.

SUMMARY

The present disclosure provides a noise reduction type purge control solenoid valve that reduces noise generated during operation of a purge control solenoid valve through a noise reduction member disposed in the purge control solenoid valve.

In accordance with one aspect of an exemplary embodiment of the present disclosure, a noise reduction type purge control solenoid valve may include a body having a connector configured to supply electricity from an external source; a cover coupled to the body, including a fluid inlet and a fluid outlet, and formed with a fluid discharge passage connected to the fluid outlet therein; a solenoid component disposed in the body; an armature disposed between the solenoid component and the fluid discharge passage and configured to move upward and downward by the solenoid component to open and close the fluid discharge passage; a noise reduction member mounted on the armature to reduce noise generated by contact between the fluid discharge passage and the armature; and a noise reduction wall protruding along a circumference of an upper surface of the noise reduction member.

The solenoid component may further include a solenoid port disposed in the body; a bobbin component disposed in the solenoid port; a solenoid core positioned at the center of the bobbin component; a coil wound around an exterior portion of the bobbin component; and a plate coupled to an upper portion of the bobbin component, disposed to adjacent to the armature, and magnetized when power is applied to the coil. The solenoid component may further include a spring inserted into a spring accommodating component formed at a lower portion of the armature and supported by the solenoid core to elastically support the armature.

The noise reduction member may be formed with a fastening protrusion. The armature may be formed with a fastening aperture into which the fastening protrusion is inserted to allow the noise reduction member to be mounted on the armature. A plurality of protrusions for dispersing noise may be formed on an interior surface of the noise reduction wall.

The noise reduction wall may further include a blocking wall formed at an upper portion thereof to protrude toward the center of the noise reduction member to obstruct noise emission. The noise reduction type purge control solenoid valve may further include a ring filter disposed in the cover and that reduces noise generated when a fluid is introduced through the fluid inlet.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Hereinafter, an exemplary embodiment of the present disclosure will be described in detail with reference to the accompanying drawings, in which exemplary embodiments of the disclosure are shown. While the invention will be described in conjunction with exemplary embodiments, it will be understood that present description is not intended to limit the invention to those exemplary embodiments. On the contrary, the disclosure is intended to cover not only the exemplary embodiments, but also various alternatives, modifications, equivalents and other embodiments, which may be included within the spirit and scope of the disclosure as defined by the appended claims.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

It is understood that the term "vehicle" or "vehicular" or other similar term as used herein is inclusive of motor vehicle in general such as passenger automobiles including sports utility vehicles (SUV), buses, trucks, various commercial vehicles, watercraft including a variety of boats, ships, aircraft, and the like and includes hybrid vehicles, electric vehicles, combustion, plug-in hybrid electric vehicles, hydrogen-powered vehicles and other alternative fuel vehicles (e.g. fuels derived from resources other than petroleum).

Figure 1:
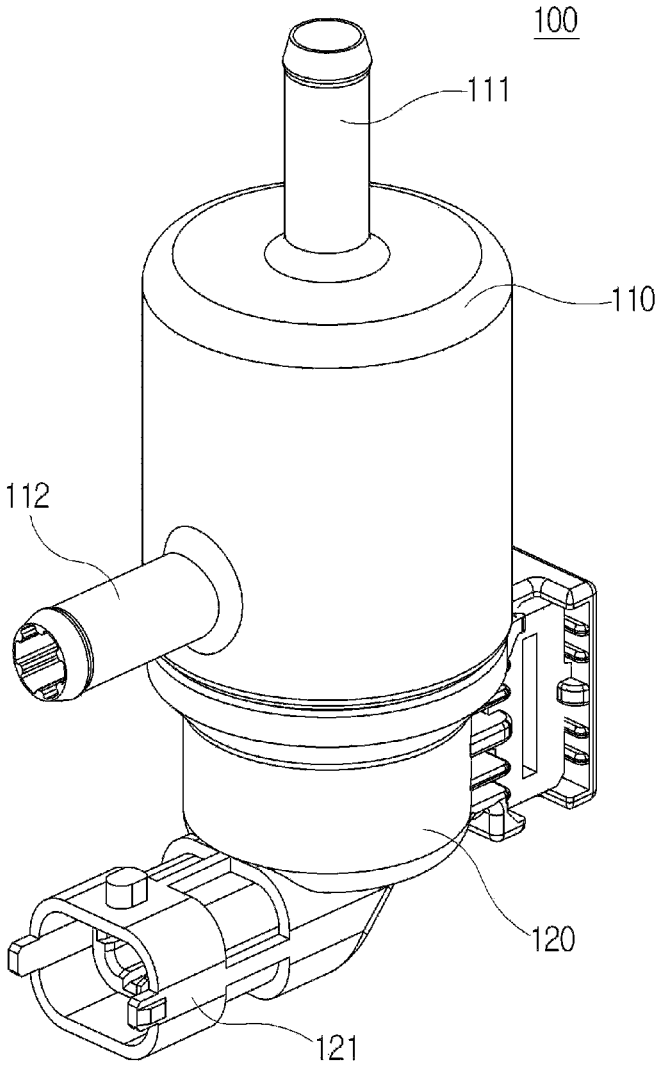
FIG. 1 is an exemplary perspective view of a noise reduction type purge control solenoid valve according to an exemplary embodiment of the present disclosure.

FIG. 1 is an exemplary perspective view of a noise reduction type purge control solenoid valve according to an exemplary embodiment of the present disclosure. Referring to FIG. 1, a noise reduction type purge control solenoid valve 100 may include a body 120 having a connector to receive electricity supplied from the exterior and a cover 110 mounted on the body 120. The cover 110 may have a side surface formed with a fluid inlet 112 through which a fluid is introduced, and an upper surface formed with a fluid outlet 111 through which the fluid is discharged.

Figure 2:
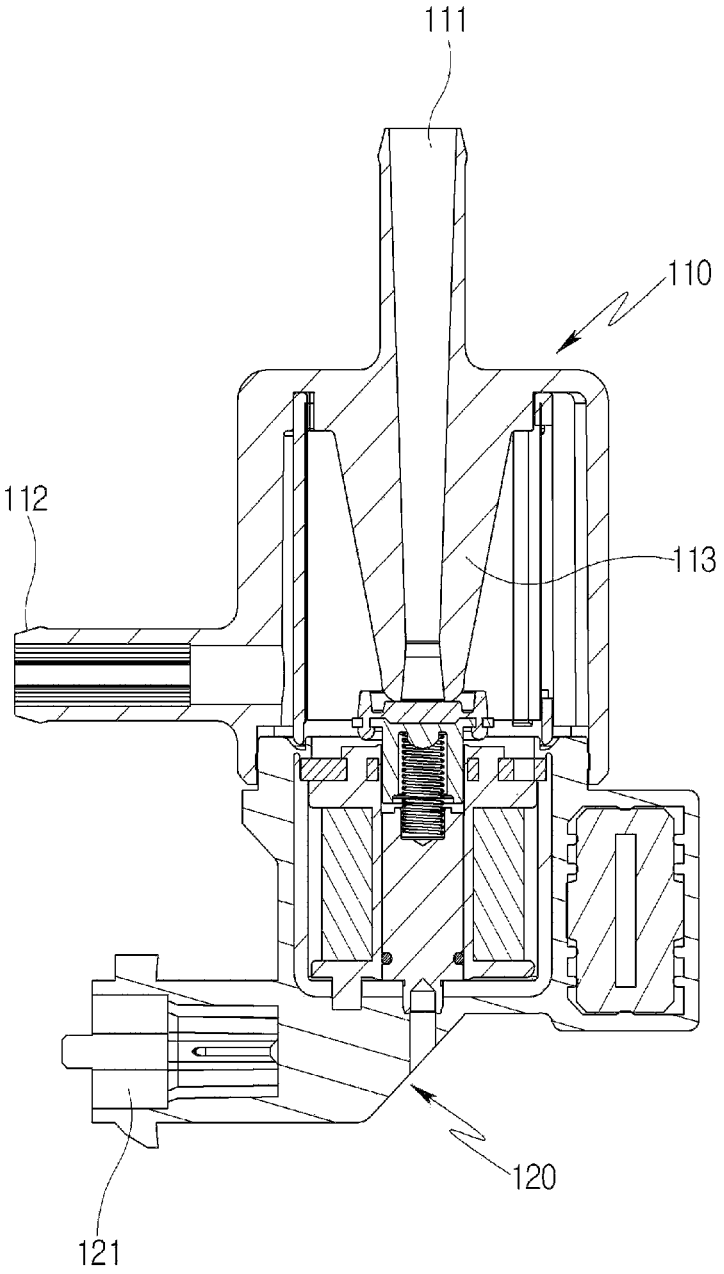
FIG. 2 is an exemplary longitudinal cross-sectional view of the noise reduction type purge control solenoid valve according to an exemplary embodiment of the present disclosure.
Figure 3:
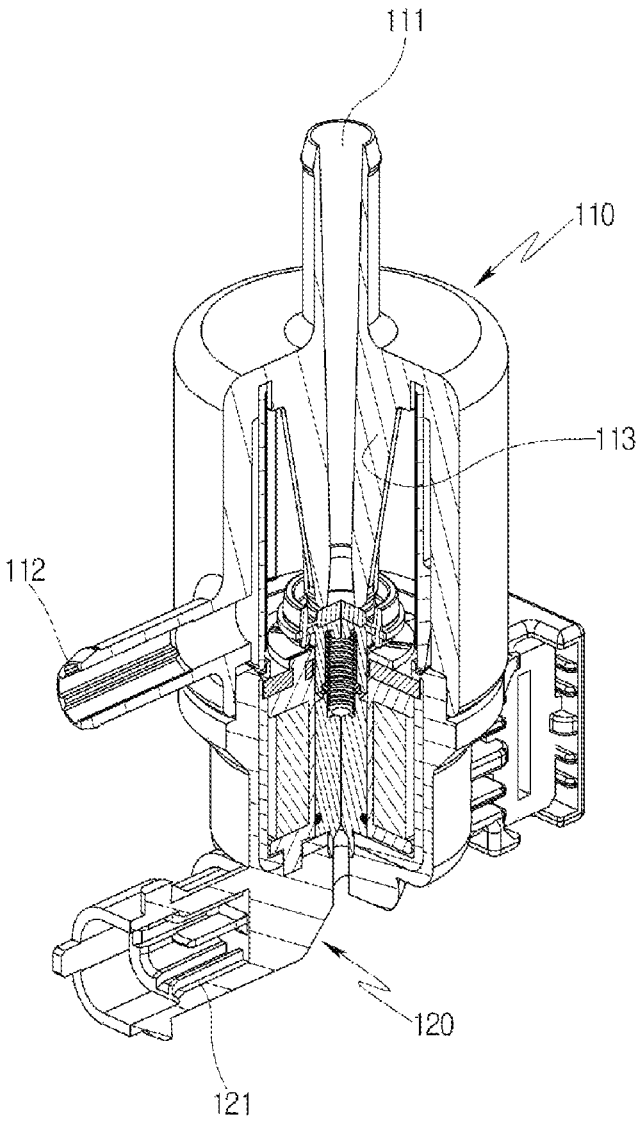
FIG. 3 is an exemplary partially cut-away perspective view of the noise reduction type purge control solenoid valve according to an exemplary embodiment of the present disclosure.
Figure 4:
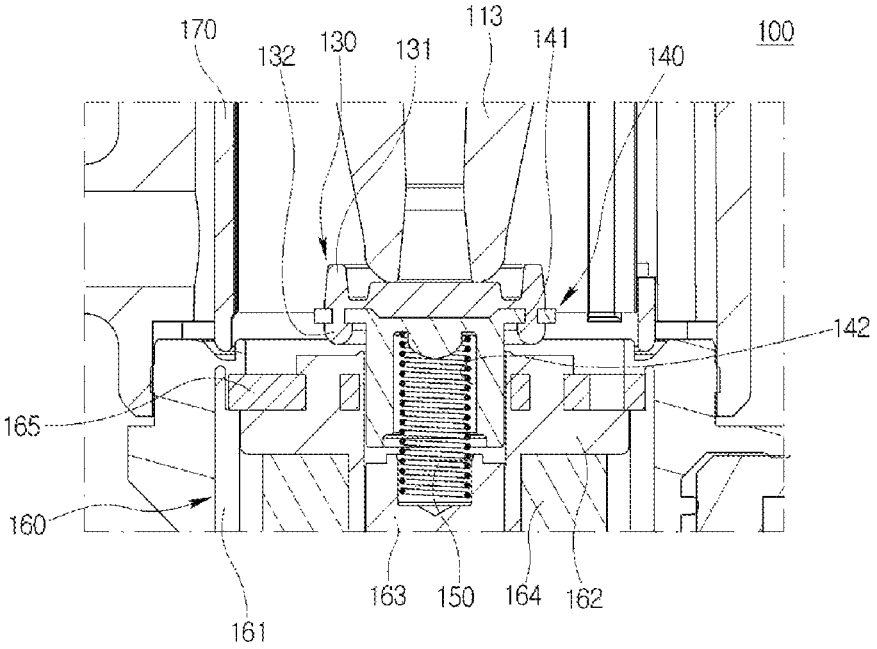
FIG. 4 is an exemplary enlarged view of portion of the noise reduction type purge control solenoid valve according to an exemplary embodiment of the present disclosure.

Referring to FIGS. 2 to 4, a fluid discharge passage 113 connected to the fluid outlet 111 may be formed in the cover 110, and the fluid may be introduced through the fluid inlet 112 and passes through the fluid discharge passage 113 to be discharged through the fluid outlet 111. Further, a ring filter 170 may be provided on an interior wall of the cover 110 at the fluid inlet 112 side in order to prevent noise generated when the fluid is introduced through the fluid inlet 112. Accordingly, the noise generated when the fluid is introduced may be filtered through the ring filter 170. An armature 140 opening and closing the fluid discharge passage 113 may be disposed below the fluid discharge passage 113, and may be configured to move in an upward and downward direction by a solenoid component 160 positioned in the body 120. When the armature 140 moves downward, the fluid discharge passage 113 is open and the fluid is discharged.

Further, a noise reduction member 130 for reducing noise may be disposed on the armature 140, and may be in contact with a lower portion of the fluid discharge passage 113. The noise reduction member 130 may be configured to move upward and downward together with the armature 140 by the solenoid component 160 positioned in the body 120. For example, when the noise reduction member 130 moves downward, the fluid is discharged to the fluid discharge passage 113 through a space between the fluid discharge passage 113 and the noise reduction member 130. At this time, noise may be generated when the fluid is discharged to the fluid discharge passage 113 and operating noise may be generated due to contact between the fluid discharge passage 113 and the noise reduction member 130. A noise reduction wall 131 may be formed along a circumference of the noise reduction member 130. Accordingly, the noise may be reduced by a collision with the noise reduction wall 131 to be dispersed. In other words, the noise generated when the armature 140 moves upward and downward may be radially spread, and may be obstructed and attenuated by the noise reduction wall 131 before the noise is transferred to the exterior.

The solenoid component 160 may be configured to enable a solenoid port 161 to be accommodated in the body, and a bobbin component 162 may be disposed in the solenoid port 161. A solenoid core 163 may be positioned at the center of the bobbin component 162, a coil 164 may be wound around an exterior surface of the bobbin component 162, and the solenoid component 160 may be configured to include a plate 165 coupled to an upper portion of the bobbin component 162, facing the armature 140, and magnetized when power is applied to the coil 164. Therefore, when power is applied to the coil 164, a magnetic field may be formed with the solenoid core 163 as its center, and the plate 165 may be magnetized to allow the armature 140 to be displaced in a downward direction.

A spring accommodating portion 142 may be formed at a lower portion of the armature 140 and a spring 150 may be accommodated in the spring accommodating portion 142. The spring 150 may be supported by the solenoid core 163, and may elastically support the armature 140 when power is not applied to the coil 164. On the contrary, when power is applied to the coil 164, the armature 140 may be displaced in a downward direction to secure a space between the armature 140 and the fluid discharge passage 113. A fastening protrusion 132 protruding downward may be formed at one side of the noise reduction member 130, and a fastening aperture 141 may be formed in the armature 140 to correspond to the fastening protrusion 132. Therefore, the fastening protrusion 132 of the noise reduction member 130 may be elastically inserted into the fastening aperture 141 to be mounted.

Figure 5:
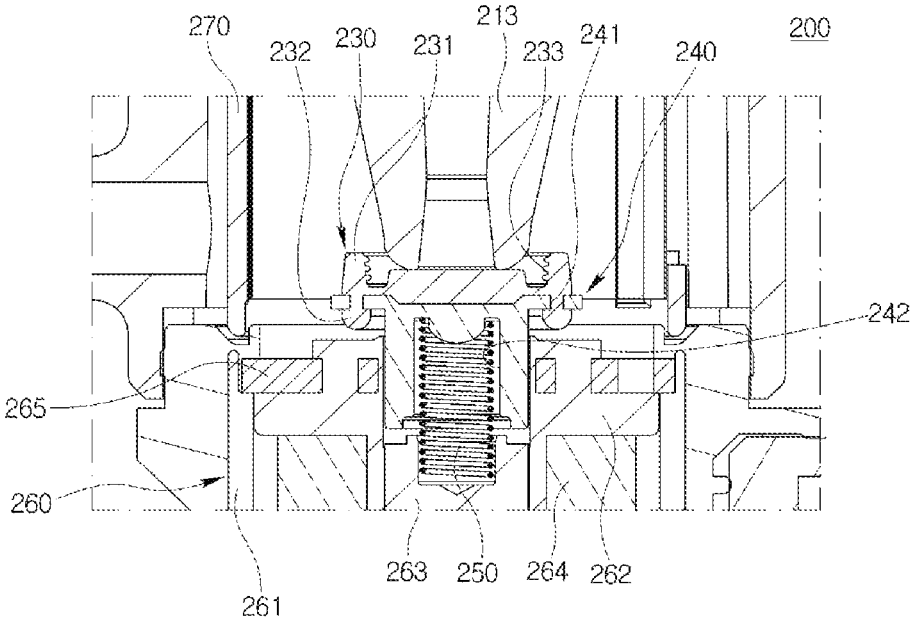
FIG. 5 is an exemplary enlarged view of a portion of a noise reduction type purge control solenoid valve according to another exemplary embodiment of the present disclosure.

FIG. 5 is an exemplary enlarged view of a noise reduction member of a noise reduction type purge control solenoid valve according to an exemplary embodiment of the present disclosure. Referring to FIG. 5, a noise reduction member 230 may be formed with a noise reduction wall 231 protruding upward, and a plurality of protrusions 233 may be formed on an interior surface of the noise reduction wall 231. Therefore, noise may be radially spread when a fluid discharge passage 213 and an armature 240 contact each other. At this time, the plurality of protrusions 233 formed on the interior surface of the noise reduction wall 231 may disperse the noise thereby generally reducing noise. Other configurations are identical to those described with reference to FIGS. 1 to 4, thus detailed description thereof will be omitted.

Figure 6:
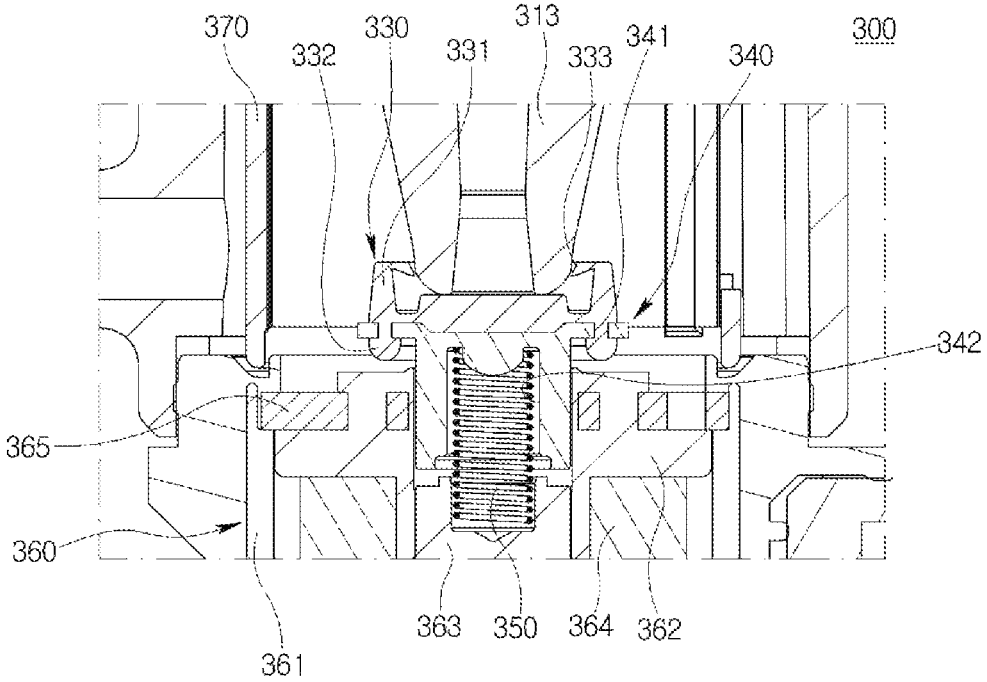
FIG. 6 is an exemplary enlarged view of portion of a noise reduction type purge control solenoid valve according to another exemplary embodiment of the present disclosure.

FIG. 6 is an exemplary enlarged view of a noise reduction member of a noise reduction type purge control solenoid valve according to an exemplary embodiment of the present disclosure. Referring to FIG. 6, a noise reduction member 330 may be formed with a noise reduction wall 331 protruding upward, and a blocking wall 333 that protrudes while being inclined toward the center of the noise reduction member 330 may be additionally formed at an upper portion of the noise reduction wall 330. The blocking wall 333 may obstruct noise primarily reduced by the noise reduction wall 331. The blocking wall 333 may be formed to be spaced apart from an exterior surface of a fluid discharge passage 313 at a predetermined interval, and may have a shape in which it is inclined toward the center of the noise reduction member 330. Therefore, introduction of the fluid may be improved but noise emission to the exterior of the blocking wall 333 may be minimized Other configurations are identical to those described with reference to FIGS. 1 to 4, thus detailed description thereof will be omitted.

As described above, according to the present disclosure, the noise reduction type purge control solenoid valve may include the noise reduction member and the noise reduction wall therein. Accordingly, the noise may be reduced even at the time of a repetitive operation of the purge control solenoid valve and shock is absorbed, thereby improving quiet in a vehicle.

Hereinabove, although the exemplary embodiments of the present disclosure have been described with reference to the accompanying drawings, but those having ordinary skill in the art to which the present disclosure pertains may variously apply and modify the above-described contents without departing from the scope of the present disclosure.

What is claimed is:

1. A noise reduction type purge control solenoid valve, comprising:

a body including a connector configured to supply electricity from exterior;

a cover coupled to the body having a fluid inlet and a fluid outlet, and formed with a fluid discharge passage connected to the fluid outlet therein;

a solenoid component disposed in the body;

an armature disposed between the solenoid component and the fluid discharge passage and configured to move upward and downward by the solenoid component to open and close the fluid discharge passage;

a noise reduction member mounted on the armature to reduce noise generated by contact between the fluid discharge passage and the armature; and a noise reduction wall protruding upward from a radially outer end of the noise reduction member along a circumference of an upper surface of the noise reduction member to surround a contact surface where the noise reduction member and the fluid discharge passage are in contact, wherein the noise reduction wall is formed radially outward from the contact surface, wherein a noise generated when the fluid discharge passage and the noise reduction member contact each other is obstructed and attenuated by the noise reduction wall before the noise is transmitted to the exterior of the body, wherein the noise reduction member is formed with a fastening protrusion which protrudes downward from the radially outer end of the noise reduction member, and the armature is formed with a fastening aperture into which the fastening protrusion is inserted to allow the noise reduction member to be mounted on the armature, wherein a blocking wall is formed at an upper portion of the noise reduction wall, the blocking wall arranged to protrude toward a center of the noise reduction member so as to allow introduction of a fluid but obstruct noise emission, wherein the noise reduction member, the noise reduction wall, the fastening protrusion, and the blocking wall are integrally formed, and the blocking wall is formed to protrude radially inward from an upper end of the noise reduction, wherein the noise is attenuated in a space surrounded by the noise reduction member, the noise reduction wall, and the blocking wall, and wherein the blocking wall is spaced apart from an exterior surface of the fluid discharge passage, and the fluid is disposed to be introduced between the blocking wall and the outer surface of the fluid discharge passage.

2. The noise reduction type purge control solenoid valve of claim 1, wherein the solenoid component includes:

a solenoid port disposed in the body;

a bobbin component disposed in the solenoid port;

a solenoid core positioned at the center of the bobbin component;

a coil wound around an exterior portion of the bobbin component; and a plate coupled to an upper portion of the bobbin component, disposed to face the armature, and magnetized when power is applied to the coil.

3. The noise reduction type purge control solenoid valve of claim 2, wherein the solenoid component further includes a spring inserted into a spring accommodating portion formed at a lower portion of the armature and supported by the solenoid core to elastically support the armature.

4. The noise reduction type purge control solenoid valve of claim 1, wherein a plurality of protrusions for dispersing noise are formed on an interior surface of the noise reduction wall.

5. The noise reduction type purge control solenoid valve of claim 1, further comprising:

a ring filter disposed in the cover and configured to reduce noise generated when a fluid is introduced through the fluid inlet.

* * * * *